US010704280B2

(12) United States Patent
Butler

(10) Patent No.: US 10,704,280 B2
(45) Date of Patent: Jul. 7, 2020

(54) WALL REPAIR DEVICE AND METHOD OF USE

(71) Applicant: Terry Butler, Ridgeland, TN (US)

(72) Inventor: Terry Butler, Ridgeland, TN (US)

( * ) Notice: Subject to any disclaimer, the term of this patent is extended or adjusted under 35 U.S.C. 154(b) by 0 days.

(21) Appl. No.: 14/997,260

(22) Filed: Jan. 15, 2016

(65) Prior Publication Data

US 2016/0208506 A1 Jul. 21, 2016

Related U.S. Application Data

(60) Provisional application No. 62/104,061, filed on Jan. 15, 2015.

(51) Int. Cl.
*E04G 23/02* (2006.01)

(52) U.S. Cl.
CPC ..... *E04G 23/0207* (2013.01)

(58) Field of Classification Search
CPC ..... E04G 23/0207
See application file for complete search history.

(56) References Cited

U.S. PATENT DOCUMENTS 3,325,955 A * 6/1967 Haut ..... E04F 21/02 428/63
3,373,467 A * 3/1968 Loughrey ..... F27D 1/16 114/227
4,075,809 A * 2/1978 Sirkin ..... E04G 23/0203 52/514
4,588,626 A * 5/1986 Cologna ..... B29C 73/14 156/94
4,820,564 A * 4/1989 Cologna ..... B29C 73/14 156/98
4,961,799 A * 10/1990 Cologna ..... B29C 73/14 156/250
5,034,254 A * 7/1991 Cologna ..... B29C 73/14 156/307.4
6,044,613 A * 4/2000 Crafts ..... E04G 23/0203 29/402.09
7,121,054 B2 * 10/2006 Shock ..... E04G 23/0203 52/514.5
8,615,949 B2 * 12/2013 Georgievski ..... E04G 23/0203 411/340
2005/0204672 A1 * 9/2005 Hansen ..... E04G 23/0203 52/514
2013/0312362 A1 * 11/2013 Maanum ..... F16K 3/03 52/742.13

* cited by examiner

*Primary Examiner* — Rodney Mintz
(74) *Attorney, Agent, or Firm* — Baker Donelson

(57) ABSTRACT

A wall repair device comprising a thin, flexible disc having an inside portion surface area, an outside portion surface area and an outside perimeter located around the outside edge of the disc and a center portion located in the center of the disc, wherein the center portion is an attachment means; a wand removeably attachable to the center portion of the disc; and wherein the outside perimeter of the disc is collapsible towards and in the direction of the length of the wand when the wand is attached to the center portion of the disc. A method to repair a hole in a wall, wherein the wall is made of drywall plaster or plaster lathe, is also disclosed herein.

8 Claims, 14 Drawing Sheets

WALL REPAIR DEVICE AND METHOD OF USE

FIELD

The technology disclosed herein is related to a device and method to repair a hole in a wall, wherein the wall is typically made of drywall plaster or plaster lathe.

BRIEF SUMMARY

A wall repair device is disclosed. In one example embodiment, the wall repair device comprises: a thin, flexible disc having an inside portion surface area, an outside portion surface area and an outside perimeter located around the outside edge of the disc and a center portion located in the center of the disc, wherein the center portion is an attachment means; a wand removeably attachable to the center portion of the disc; and wherein the outside perimeter of the disc is collapsible towards and in the direction of the length of the wand when the wand is attached to the center portion of the disc. A method to repair a hole in a wall, wherein the wall is made of drywall plaster or plaster lathe, is also disclosed. In one embodiment, the method comprises the following steps: (a) obtaining the wall repair device comprising (i) a thin, flexible disc having an inside portion surface area, an outside portion surface area, an outside perimeter, and a center attachment receiving portion centrally located on the disc, wherein the disc has a diameter of at least six inches; (ii) a wand having a length of at least six inches, wherein the wand is removeably attachable to the center portion of the disc; and wherein the outside perimeter of the disc is collapsible towards and in the direction of the length of the wand when the wand is attached to the center portion of the disc; (b) attaching the wand to the disc at the center portion of the disc; (c) applying an adhesive to the inside portion of the surface area of the disc; (d) inserting the disc into the hole of the wall with the outside portion of the disc facing the wall upon insertion allowing the disc to collapse upon insertion into the wall and un-collapse once the perimeter of the disc has passed through the backboard of the wall; (e) pulling the disc in the direction of the user allowing the adhesive on the inside portion of the surface area of the disc make contact with the wall; and (f) removing the wand from the disc.

DETAILED DESCRIPTION

Figure 1:
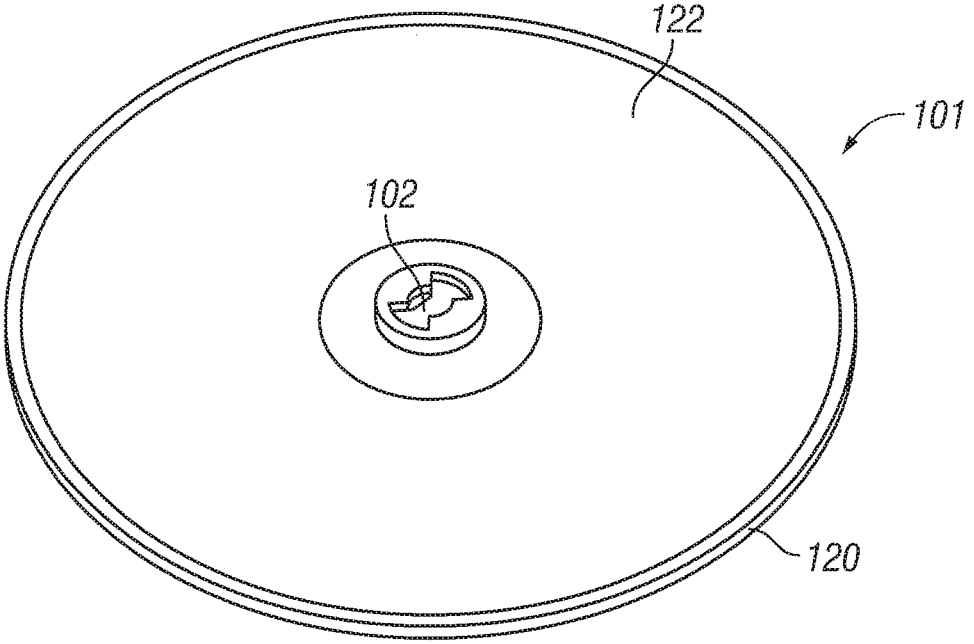
FIG. 1 depicts a perspective view of a disc of the wall repair device according to one example embodiment.
Figure 2:
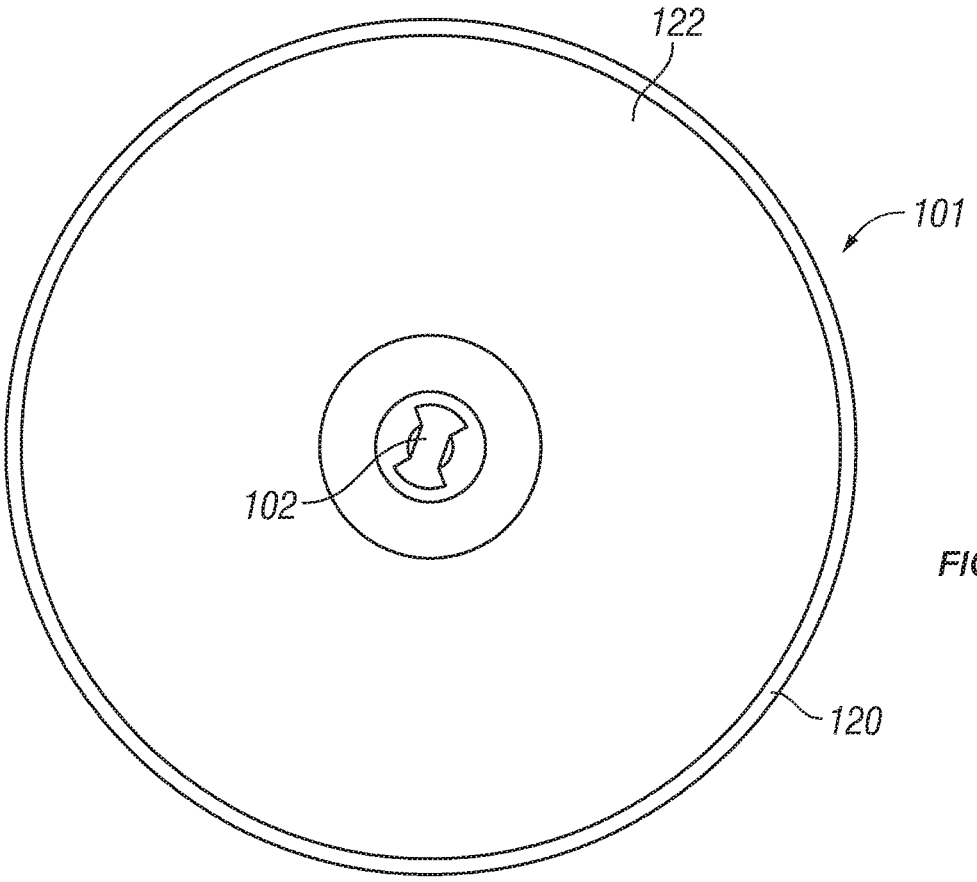
FIG. 2 depicts a front view of the disc shown in FIG. 1.
Figure 3:
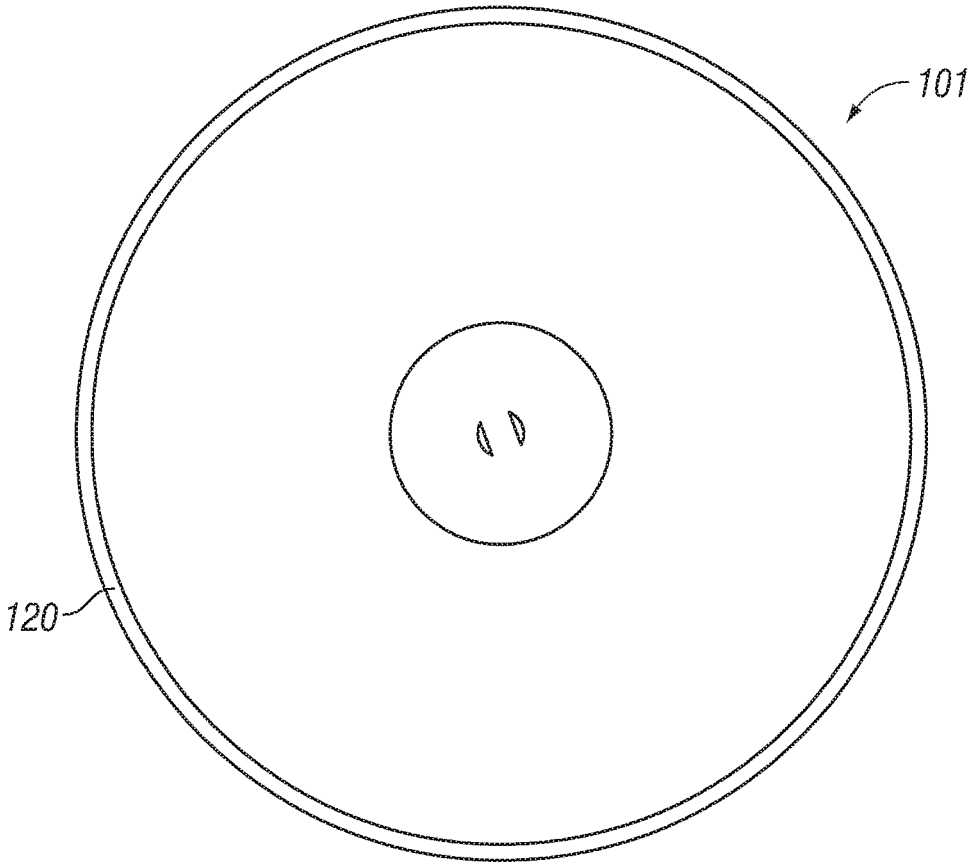
FIG. 3 depicts a back view of a disc in FIG. 1.
Figure 4:
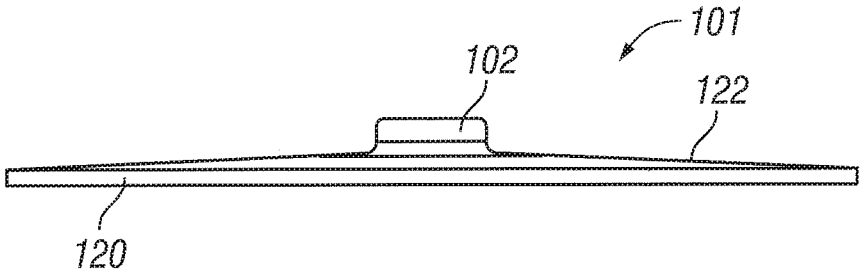
FIG. 4 depicts a side view of a disc in FIG. 1.
Figure 5:
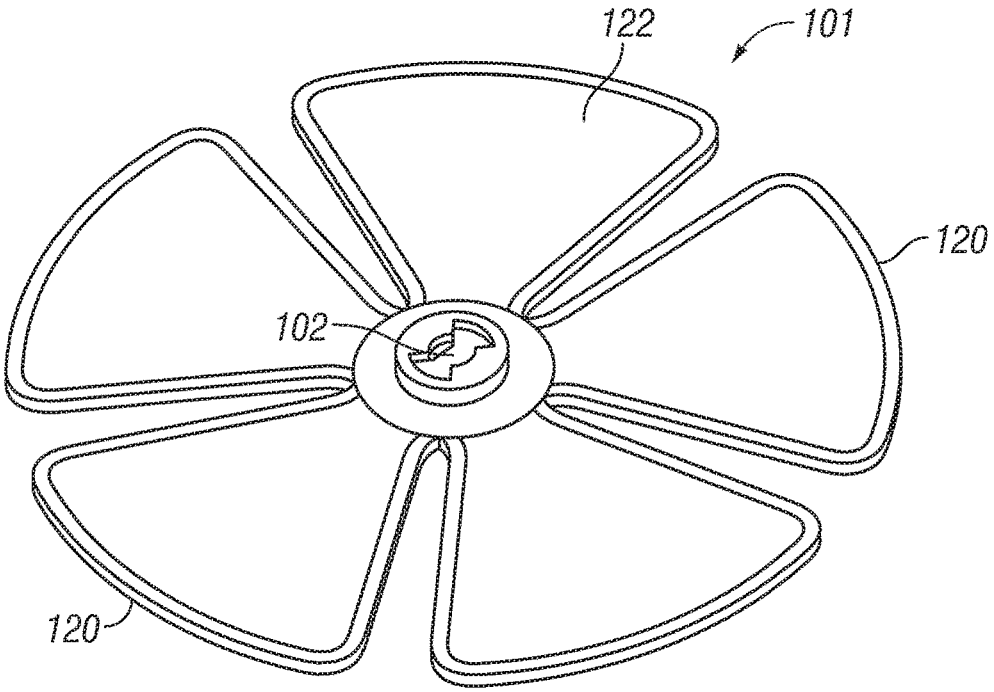
FIG. 5 depicts a perspective view of a disc of the wall repair device according to another example embodiment.
Figure 6:
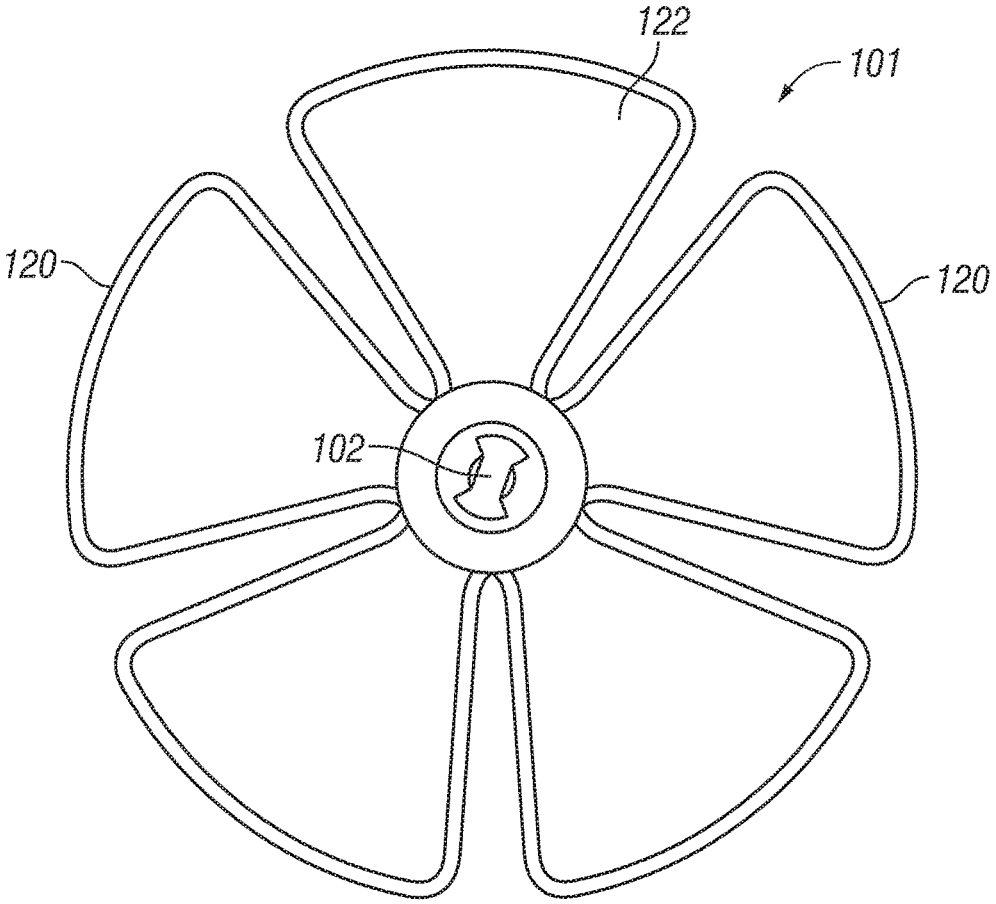
FIG. 6 is a front view of the disc shown in FIG. 5.
Figure 7:
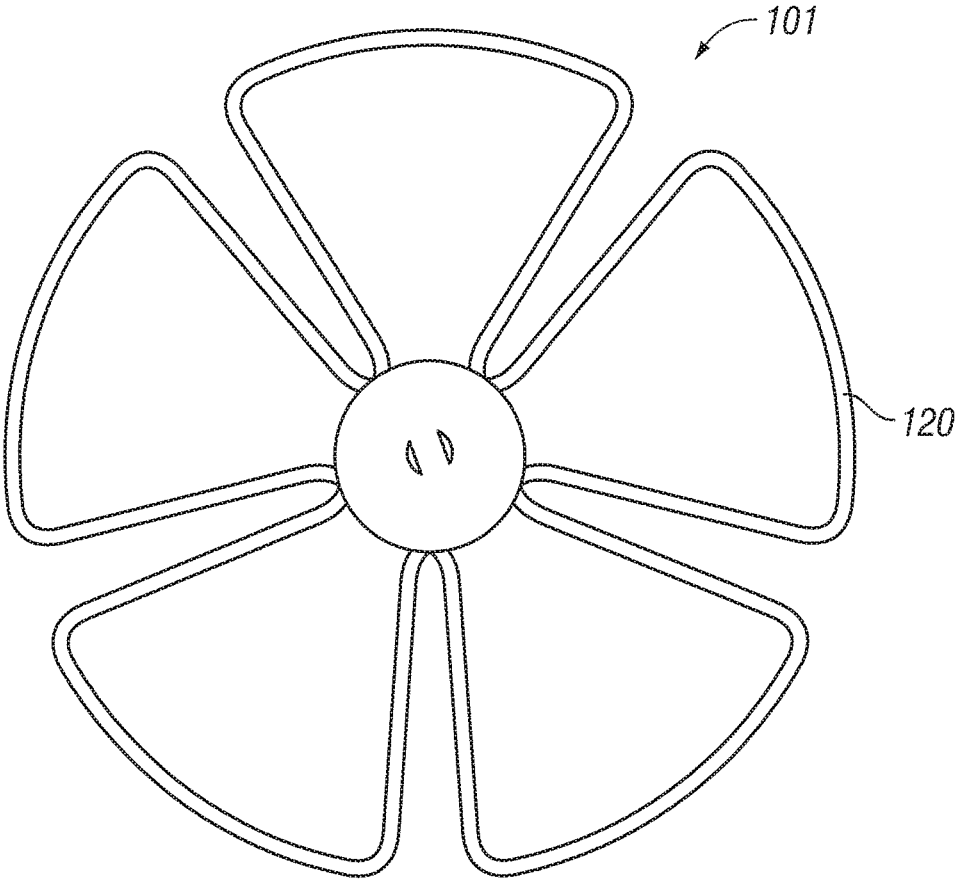
FIG. 7 is a back view of the disc shown in FIG. 5.
Figure 8:
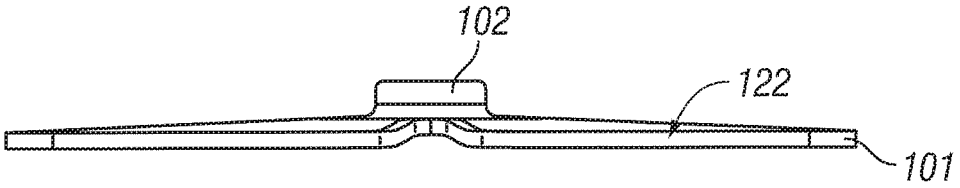
FIG. 8 is a side view of the disc in FIG. 5.
Figure 9:
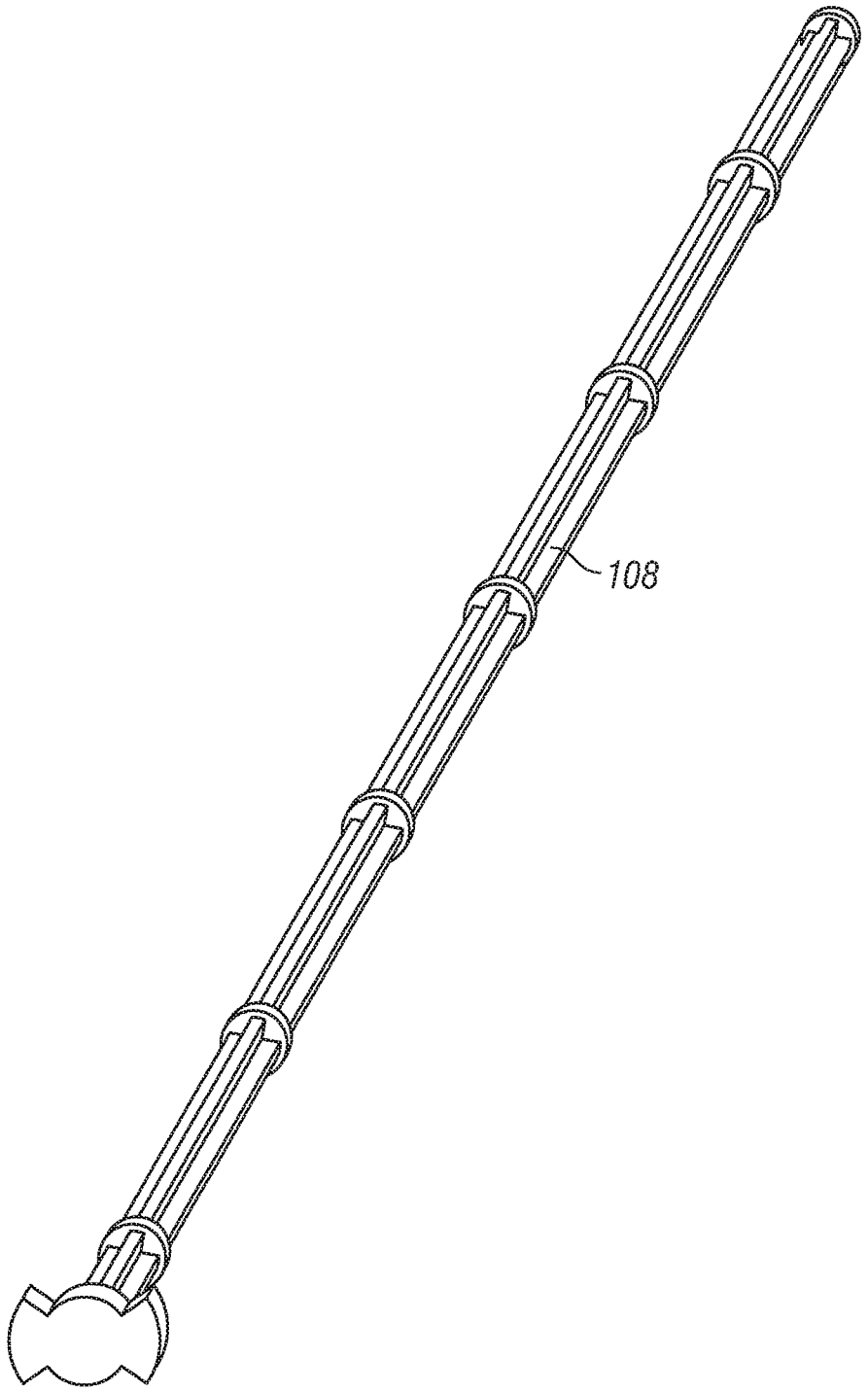
FIG. 9 is a perspective view of the wand of the wall repair device according to an example embodiment.
Figure 10:
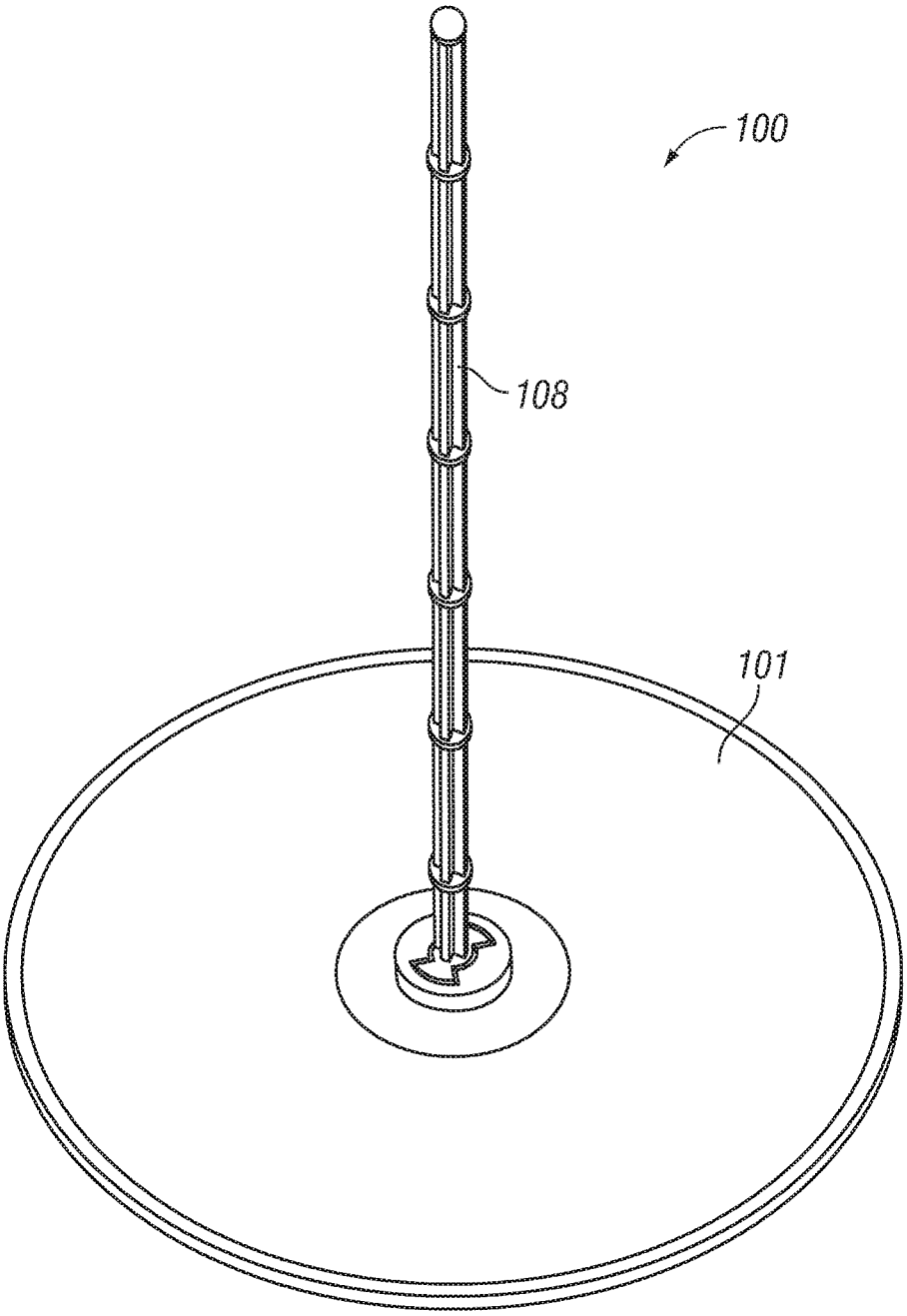
FIG. 10 is a perspective view of the wall repair device wherein the wand is attached to the disc according to an example embodiment.
Figure 11:
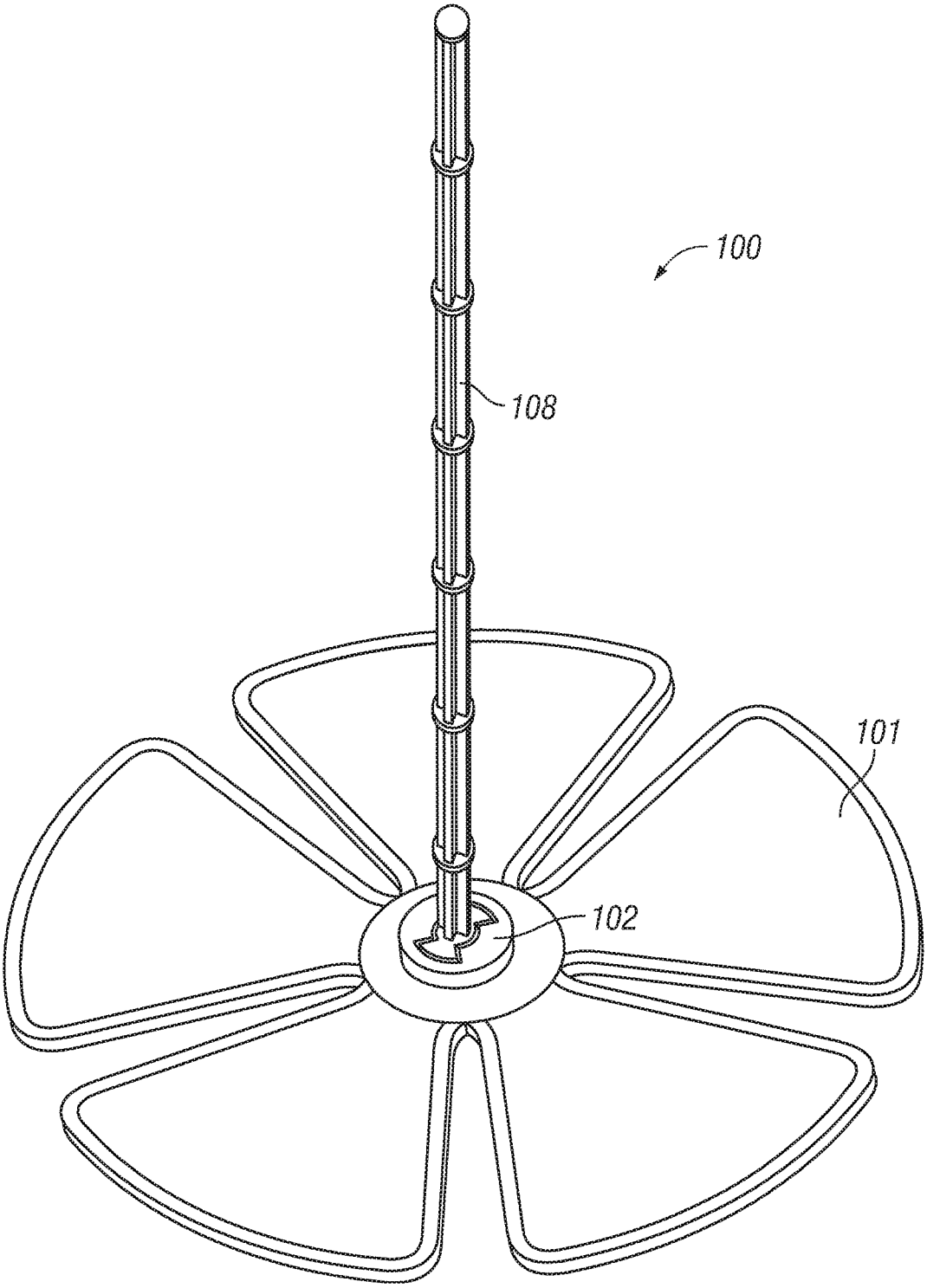
FIG. 11 is a perspective view of the wall repair device wherein the wand is attached to the disc according to another example embodiment.
Figure 12:
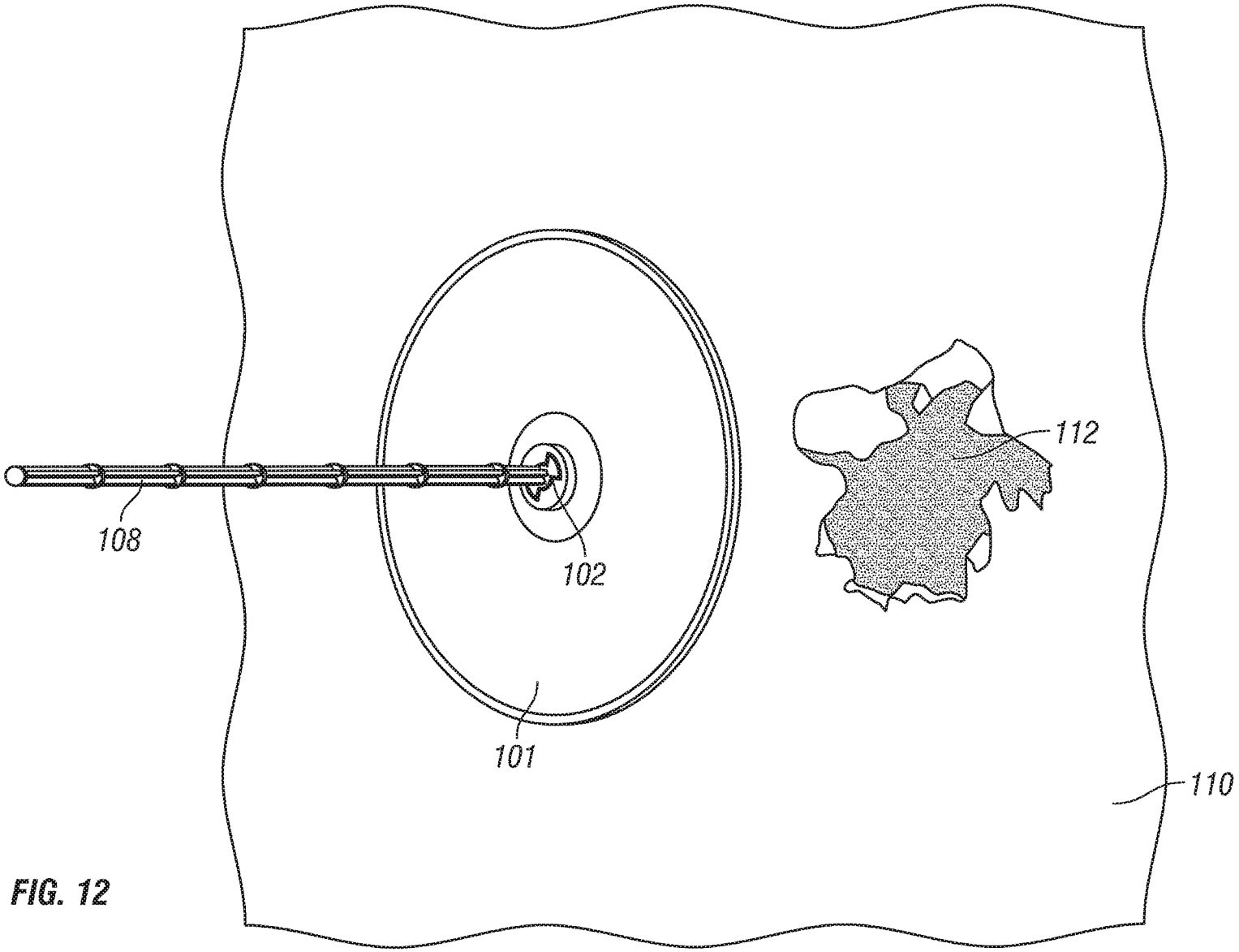
FIG. 12 is a perspective view of the wall repair device approaching a hole in the layers of a wall.
Figure 13:
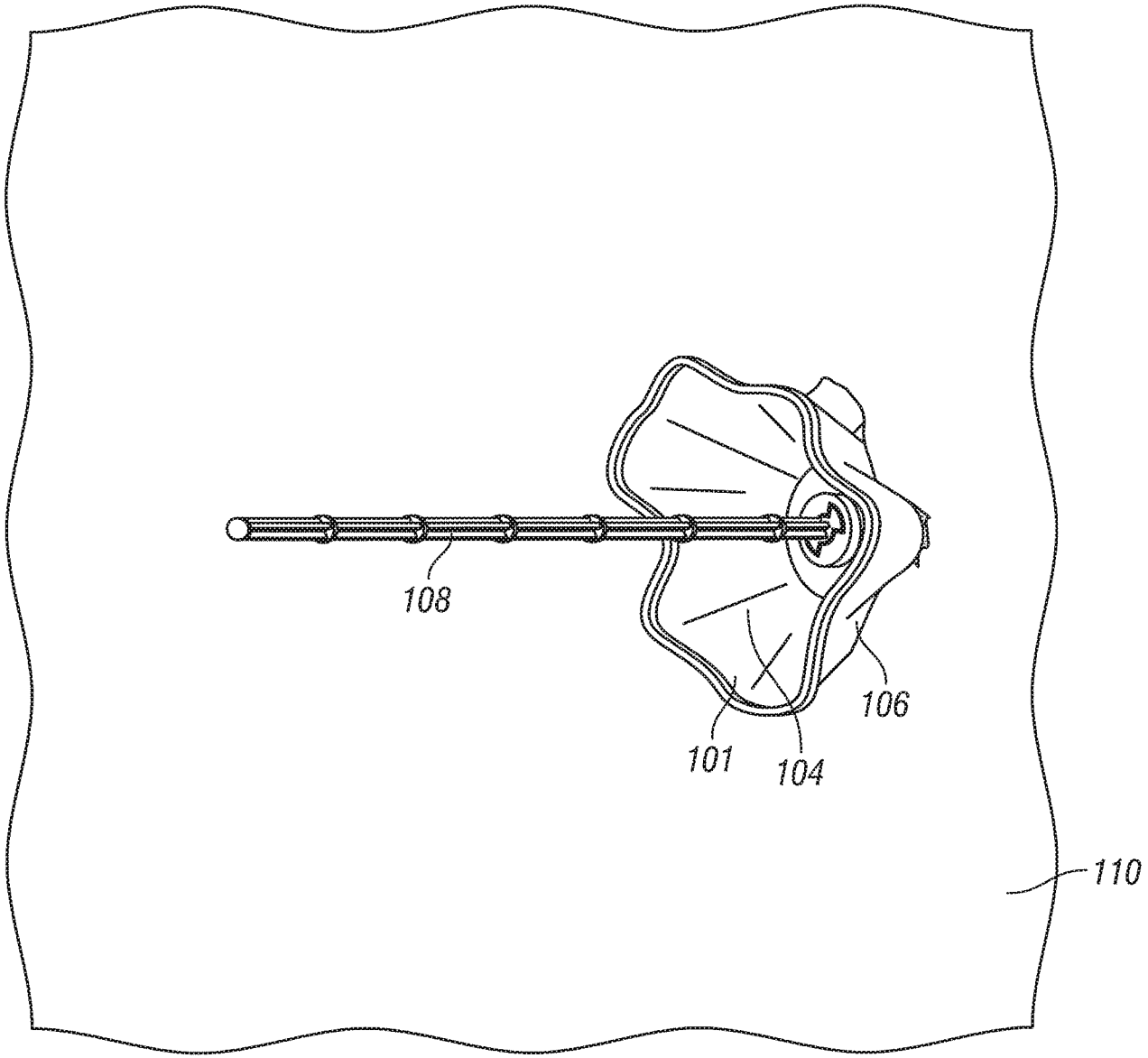
FIG. 13 is a perspective view of the wall repair device where the disc is being inserted into the wall shown in FIG. 12, wherein the disc is collapsing upon insertion into the hole in the wall.
Figure 14:
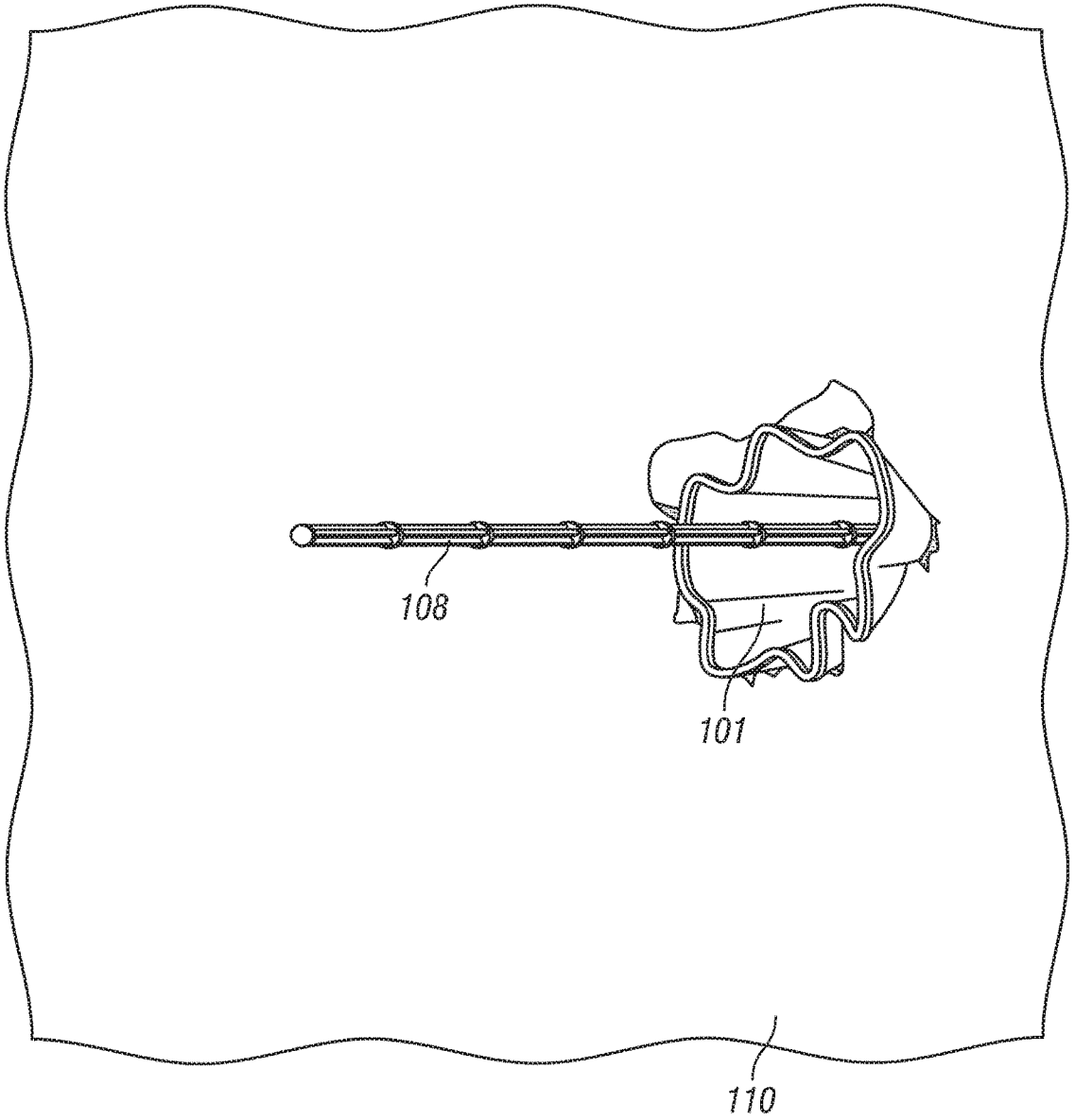
FIG. 14 is a perspective view of the wall repair device of FIG. 12, wherein the disc is further being inserted into the wall shown in FIG. 12.
Figure 15:
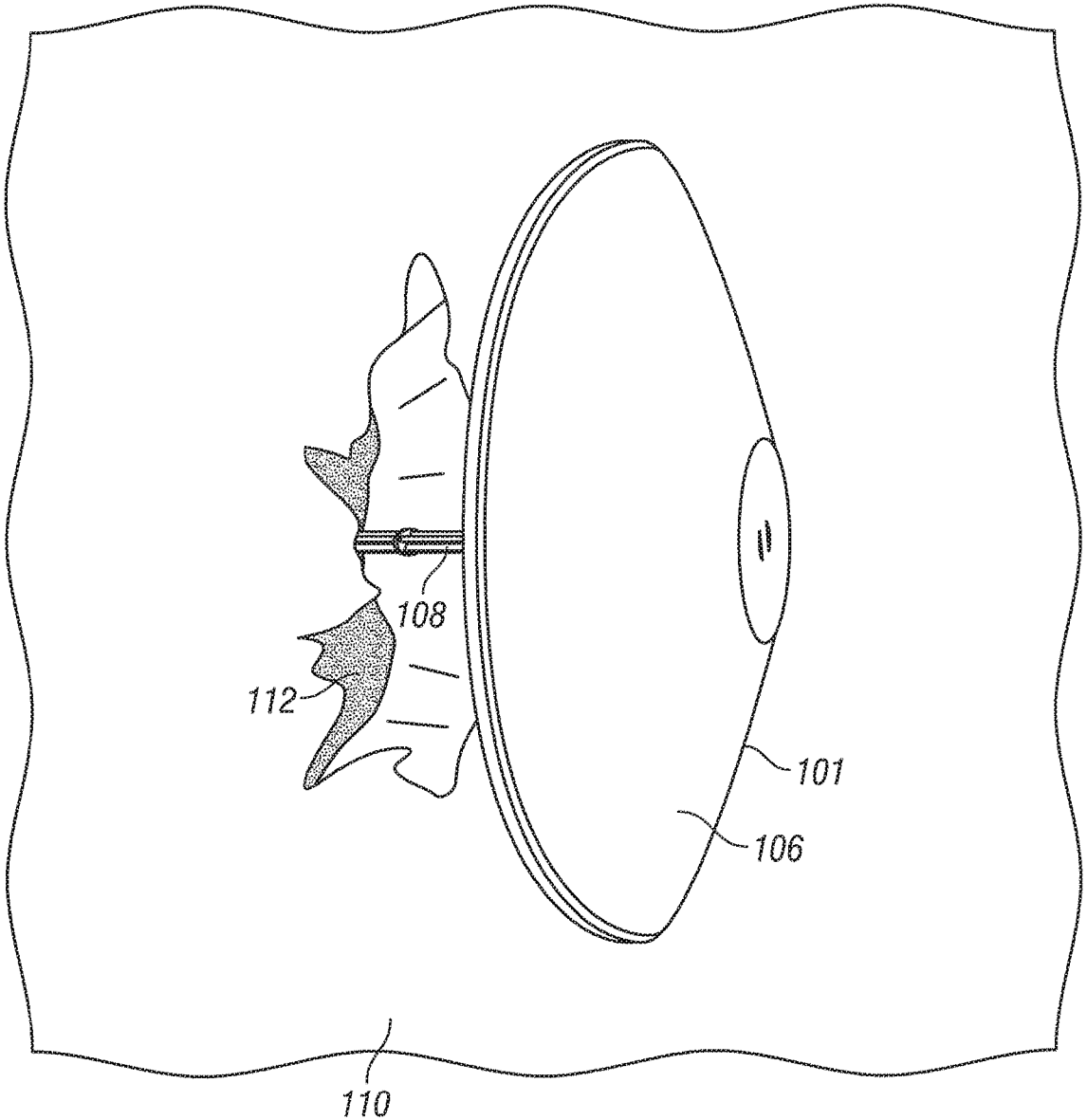
FIG. 15 depicts a perspective partial view of the wall repair device of FIGS. 12-14, wherein the view is from the blind side of the hole in the wall (or from behind the wall), wherein the outside of the disc is shown.
Figure 16:
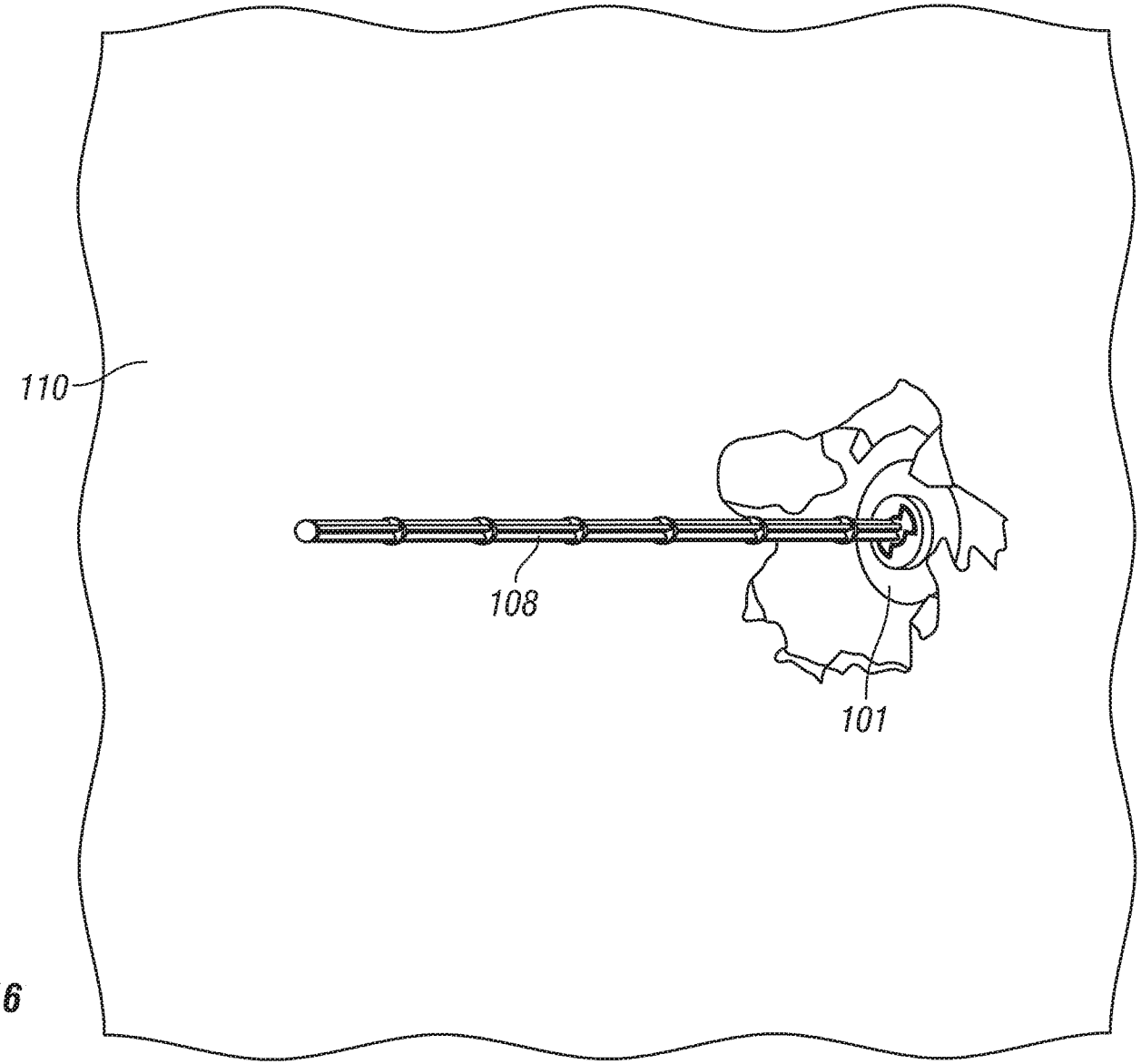
FIG. 16 depicts a partial view of the wall repair device wherein the disc has been completely inserted through the hole of the wall of FIG. 12 and wherein the wand is attached.
Figure 17:
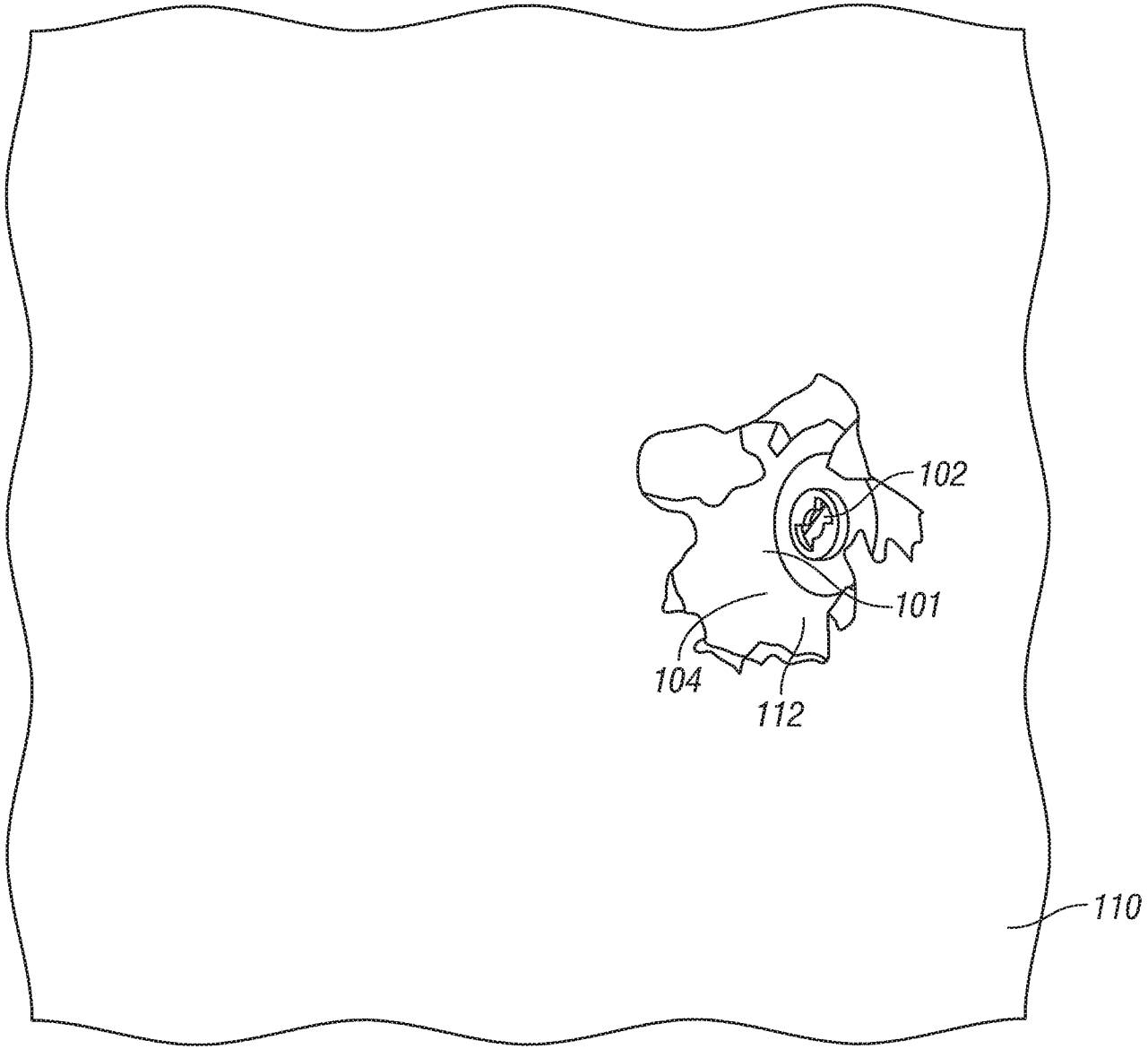
FIG. 17 depicts a partial view of the disc of the wall repair device wherein the disc is attached to the back side of the wall and wherein the wand has been removed from the disc.
Figure 18:
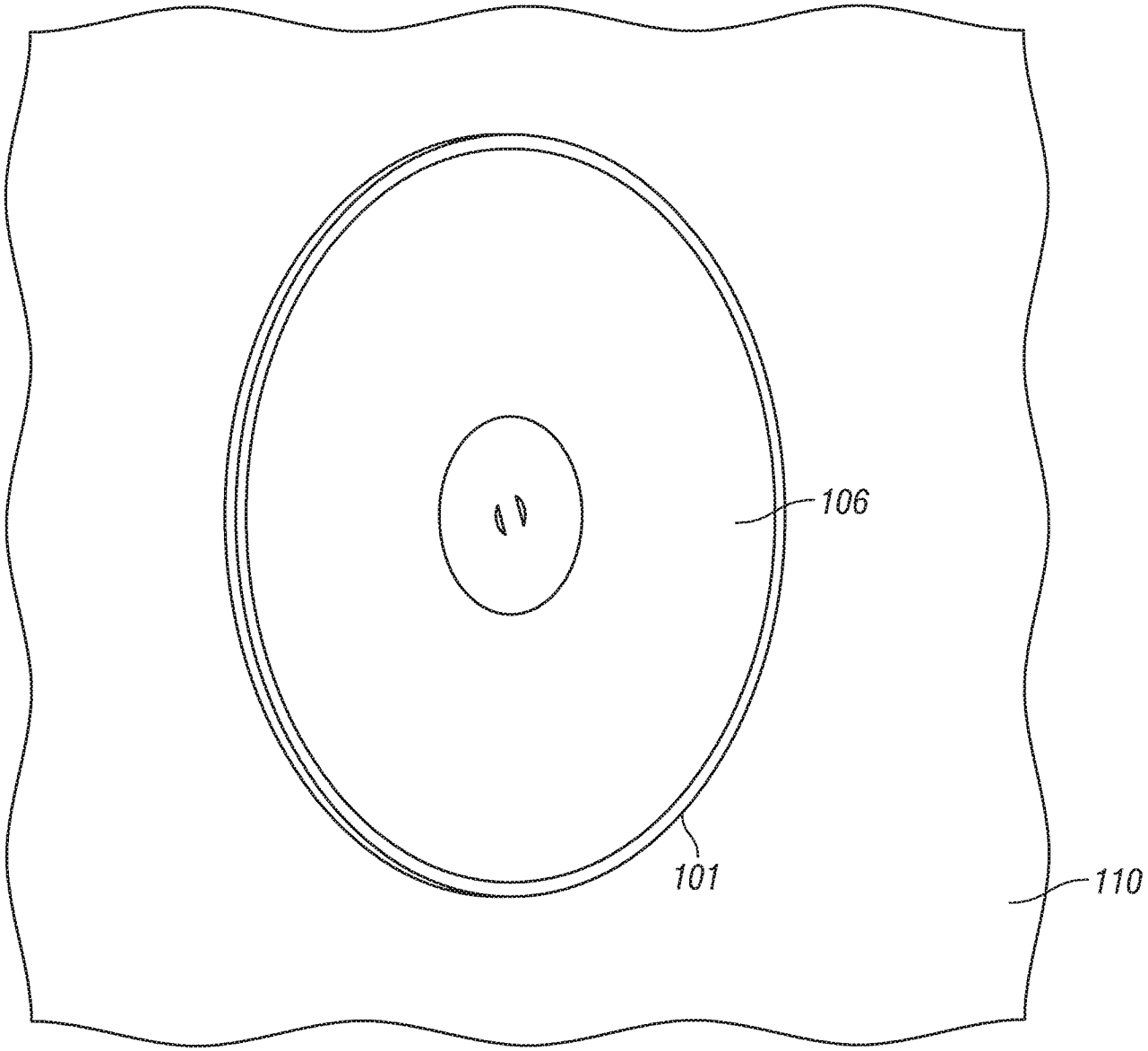
FIG. 18 is a perspective view of the disc of the wall repair device attached to the back of the wall of FIGS. 12-17.

Referring to FIGS. 1-18, a wall repair device 100 may be used to repair damaged walls. The wall repair device 100 may be used to repair holes in walls made of materials such as in drywall plaster and plaster lathe. Typically drywall plaster layers comprise three layers a backboard, spackling and a cover layer. The wall repair device 100 may be used to repair holes in materials other than drywall plaster and plaster lathe, as desired by one of skill in the art. In one embodiment, the wall repair device 100 may be used to repair holes having a diameter of around six inches or less. The wall repair device 100 allows a hole 112 in a wall 110 to be restored and repaired to its original strength. The wall repair device 100 does more than merely patch or cover up a hole in the wall. A method of use to install the wall repair device is also disclosed.

Referring again to FIGS. 1-18, in one embodiment, the wall repair device includes a disc 101 and wand 108. In one embodiment, a thin, flexible disc 101 comprises an inside portion surface area 122, an outside portion surface area (opposite 122) and an outside perimeter 120 located around the outside edge of the disc 101 and a center portion located in the center of the disc. Disc 101 is inserted into a hole 112 of a wall 110 and replaces the backboard of the dry wall plaster layer as disclosed below. In one embodiment, the disc 101 is substantially flat and circular. In another embodiment, the disc 101 may be slightly concave and circular. The disc 101 may be other shapes than circular, such as oval or square, as desired by one of skill in the art. In a further embodiment, the disc 101 may be a solid disc, or the disc 101 may be have a plurality of petals or blades extending from the center portion 102 of the disc. The disc 101 may be around six inches in diameter. The disc 101 may be greater or less than six inches in diameter as desired by one of skill in the art. In one embodiment, the disc 101 is made of any material that allows flexibility upon insertion into and through a hole 112 to be repaired. In one embodiment, disc 101 is made of a material similar to sheet rock repair tape. In another embodiment, the disc may be made of vinyl. The disc may be made of any material as desired by one skilled in the art as long as such material allows the necessary flexibility and stability for use. In one embodiment, disc 101 has an inside 104 and an outside 106.

Referring again to FIGS. 1-18, in one embodiment, wand 108 may be six to seven inches in length but may be any length as desired by one of skill in the art. The wand 108 may be made of any material sturdy enough to allow connection of the wand 108 to the disc 101 and to allow insertion of the disc 101 into a hole 112. The wand 108 may be made of vinyl or plastic but any other material may be used as desired by one of skill in the art. The disc 101 has a center portion 102, which is an attachment means, at which point the wand 108 may be attached to disc 101. In one embodiment, the wand 108 is attached at the center portion 102 of the disc 101. In one embodiment, the disc 101 and wand 108 are snapped together. Other forms of temporarily attaching the disc 101 to the wand 108 may be used as desired by one of skill in the art. For example, the disc 101 and wand 108 may be attached by a twisting attachment means. In such example, disc 101 and wand 108 may be attached by inserting the wand 108 through the center portion 102 of the disc 101 and placing and twisting a cap on the end portion of wand 108, wherein the end portion was inserted through center portion 102 of disc 101. In such example, wand 108 may have a mechanism that allows the wand to release from the cap after device 100 is inserted into hole 112. In such example, wand 108 may have spurs or other mechanism that prevent the disc 101 at the end of wand 108 from sliding down the wand 108 away from the cap upon insertion into hole 112. Other forms of temporarily attaching the disc 101 to the wand 108 include a hook release attaching means and a screw release attaching means.

Referring again to FIGS. 1-18, the wall repair device allows a user to quickly repair a damaged wall 110 with a hole 112 having a diameter of six inches or less. To install the wall repair device, the user will attach the wand 108 to the disc 101 from the inside portion facing the wand 108. The user will then apply an adhesive to the inside portion 104 of the disc. In one embodiment, the adhesive used may be an industrial strength glue such as a "joint type" of glue commonly used in connecting pvc plumbing. In one embodiment, the adhesive may be pre-applied to the disc and covered with a film, such as plastic or wax paper, until the device is in use, and in such exemplary embodiment, the user would remove the covering so that the pre-applied adhesive is exposed. With the outside portion 106 of the disc 101 facing the wall 110, the user will insert the disc into the hole 112 of a wall 110. Upon insertion into the hole 112, the disc draws in (or collapses in) while it passes through the hole 112 and then the disc opens back up once the edges of the disc 101 have passed the wall 110 (or drywall plaster layers). After the disc 101 has been fully inserted past the backboard of wall 110 surrounding hole 112, the user may pull the wand 108 in the direction of the user until the adhesive on the inside portion 104 of disc 101 connects with the backboard of the wall 110. The user will hold the disc 101 in place until the adhesive attaches the disc 101 to the backboard of the wall 110. The user then removes the wand 108. The hole 112 may then be refilled and restored with spackling which may be smoothed over with a spackling tool. The spackling will harden and then the sanded and painted to match the existing wall. The layer of paint replaces the thin front layer or cover layer.

In a further embodiment, the device 100 comprises disc 101 and wand 108 which are permanently attached and manufactured as one piece.

A method to repair a hole in a wall, wherein the wall is made of drywall plaster or plaster lathe, is also disclosed. In one embodiment, the method comprises the following steps: (a) obtaining the wall repair device comprising (i) a thin, flexible disc having an inside portion surface area, an outside portion surface area, an outside perimeter, and a center attachment receiving portion centrally located on the disc, wherein the disc has a diameter of at least six inches; (ii) a wand having a length of at least six inches, wherein the wand is removeably attachable to the center portion of the disc; and wherein the outside perimeter of the disc is collapsible towards and in the direction of the length of the wand when the wand is attached to the center portion of the disc; (b) attaching the wand to the disc at the center portion of the disc; (c) applying an adhesive to the inside portion of the surface area of the disc; (d) inserting the disc into the hole of the wall with the outside portion of the disc facing the wall upon insertion allowing the disc to collapse upon insertion into the wall and un-collapse once the perimeter of the disc has passed through the backboard of the wall; (e) pulling the disc in the direction of the user allowing the adhesive on the inside portion of the surface area of the disc make contact with the wall; and (f) removing the wand from the disc.

The description and illustrations are by way of example only. While the description above makes reference to various embodiments, it should be understood that many changes and modifications can be made without departing from the scope of the disclosure. Many more embodiments and implementations are possible within the scope of this invention and will be apparent to those of ordinary skill in the art. The invention is not limited to the specific details, representative embodiments, and illustrated examples in this description.

I claim:

1. A wall repair device to facilitate repair of holes in drywall plaster or plaster lathe, wherein the holes have a diameter of two to six inches, the device comprising:

a thin, flexible disc of one-piece construction configured to be inserted through a respective said hole needing repair, wherein the disc comprises an inside portion surface area, an outside portion surface area, an outside perimeter and a center attachment receiving portion located centrally on the disc, wherein the disc has a diameter of at least six inches;

a wand having a length of at least six inches, wherein the wand is removably attached to the center attachment receiving portion of the disc;

wherein the disc has a plurality of petals extending around a periphery of the center attachment receiving portion of the disc; and wherein the outside perimeter of the disc is collapsible towards the length of the wand when the wand is attached to the center portion of the disc which allows the disc to be inserted in the respective hole of the drywall.

2. A method of using the wall repair of claim 1 to repair the hole in a wall, wherein the wall is made of drywall plaster or plaster lathe, wherein the method comprises the following steps:

(a) obtaining the wall repair device;

(b) attaching the wand to the disc at the center portion of the disc;

(c) applying an adhesive to the inside portion surface area of the disc;

(d) inserting the disc into the hole in the wall with the outside portion of the disc facing the wall upon insertion allowing the disc to collapse upon insertion into the wall and un-collapse once the outside perimeter of the disc has passed beyond a backboard of the wall;

(e) pulling the disc in a direction of a user allowing the adhesive on the inside portion surface area of the disc to make contact with the wall; and (f) removing the wand from the disc.

3. A wall repair system, consisting essentially of:

a wall repair device configured to facilitate repair of holes in drywall plaster or plaster lathe, wherein the holes have a diameter of two to six inches, the device having:

a thin, flexible disc, configured for insertion through a respective said hole needing repair, wherein the disc is defined by an inside portion surface area, an outside portion surface area, an outside perimeter and a center attachment receiving portion located centrally on the disc, wherein the disc has a diameter of at least six inches;

a wand having a length of at least six inches, wherein the wand is removably attached to the center attachment receiving portion of the disc; and wherein the outside perimeter of the disc is collapsible towards the length of the wand when the wand is attached to the center portion of the disc which allows the disc to be inserted in the respective hole of the drywall.

4. The system of claim 3, wherein the disc is flat.

5. The system of claim 3, wherein the disc is concave.

6. The system of claim 3, wherein the disc is square.

7. The system of claim 3, wherein the disc is circular.

8. A method of using the wall repair system of claim 3 to repair the hole in a wall, wherein the wall is made of drywall plaster or plaster lathe, wherein the method comprises the following steps:

(a) obtaining the wall repair device;

(b) attaching the wand to the disc at the center portion of the disc;

(c) applying an adhesive to the inside portion surface area of the disc;

(d) inserting the disc into the hole in the wall with the outside portion of the disc facing the wall upon insertion allowing the disc to collapse upon insertion into the wall and un-collapse once the outside perimeter of the disc has passed beyond a backboard of the wall;

(e) pulling the disc in a direction of a user allowing the adhesive on the inside portion surface area of the disc to make contact with the wall; and (f) removing the wand from the disc.

* * * * *